United States Patent [19]

Hsiao et al.

[11] 4,102,282

[45] Jul. 25, 1978

[54] METERING DEVICE FOR SEWING MACHINES

[75] Inventors: James C. Hsiao, Chicago; Robert H. Gaudlitz, Cary, both of Ill.

[73] Assignee: Union Special Corporation, Chicago, Ill.

[21] Appl. No.: 783,907

[22] Filed: Apr. 1, 1977

[51] Int. Cl.[2] ..... D05B 21/00; D05B 27/14

[52] U.S. Cl. ..... 112/121.26; 112/214; 74/812; 74/125.5

[58] Field of Search ..... 112/121.26, 121.27, 112/2, 203, 211, 214; 192/12 BA, 12 B; 74/126, 812, 125.5

[56] References Cited

U.S. PATENT DOCUMENTS

| | | | |
|---|---|---|---|
| 2,231,648 | 2/1941 | Weis | 112/121.26 |
| 2,901,991 | 9/1959 | Reimer | 112/121.26 |
| 3,207,005 | 9/1965 | Geyer | 74/812 |
| 3,625,168 | 12/1971 | Palazzo | 112/211 |
| 3,666,063 | 5/1972 | Schoeman et al. | 74/812 X |
| 3,832,914 | 9/1974 | Pinfield | 74/812 |

*Primary Examiner*—H. Hampton Hunter

*Attorney, Agent, or Firm*—John W. Harbst; John A. Schaerli

[57] ABSTRACT

A metering device for a sewing machine for supplying a predetermined length of material to the stitch forming instrumentalities. Movement is imparted to the metering device by a series of one way clutch assemblies, one of which is operably connected to a drive mechanism of the machine. A motion transfer mechanism provides for opposite movement in unison of the clutch assemblies so that any movement of the drive mechanism results in a feeding displacement of the metering device. A brake assembly applies a symetrical frictional force to one of the feed rollers so as to prevent overthrow of the device.

21 Claims, 6 Drawing Figures

METERING DEVICE FOR SEWING MACHINES

This invention relates in general to sewing machines and more particularly to a metering device for supplying a predetermined length of elastic material to the needle of the machine.

BACKGROUND OF THE INVENTION

Certain operations in the manufacture of textile products require a metering device for supplying a predetermined length of material to the needle of the machine. In many instances, it is desirable to feed an elastic material to the needle under an elasticized state. One patented invention related to elastic metering devices, is disclosed in U.S. Pat. No. 2,901,991 granted on Sept. 1, 1969 to G. M. Reimer. In this patent there is disclosed an elastic metering device for a sewing machine in which the elastic is fed through a pair of feed rollers which serve to measure and place under tension the elastic strip prior to feeding same to the needle. Of the two feed rollers disclosed in the above mentioned patent, one is connected via a rock lever to the needle drive mechanism of the machine. The driven feed roller has contained therein a clutch roller for driving the feed roller upon one direction of movement of the lever. There is also contained within the feed roller a stationary shaft which is provided with cam formations thereon so as to coact with the clutch rollers is preventing rotation of the feed roller in a direction opposite to that in which the feed rollers are initially driven but allowing a freedom of movement of the rock lever to its initial position.

As will be made more apparent hereinafter, the Reimer structure is distinguished from the present invention by the provision that all of the driving motion in the patented invention is delivered to the driven feed roller upon the downward movement of the lever. The Reimer patent also has a drawback in that a plurality of parts are contained within the feed roller and thus inaccessible.

By way of contrast, the present invention discloses means for imparting movement to the metering device upon both directions of movement of the rock lever so as to provide a more uniform speed for the feed roller. More particularly, the present invention includes a plurality of feed rollers which are supportably carried on the upper arm of the machine. As disclosed in the Reimer patent, there are suitable connections between the needle drive and the rock lever so as to oscillate the latter. This rockable or oscillatable lever is connected to a first one way clutch assembly means which is operably associated with one of said feed rollers for imparting movement thereto. The driven feed roller further carries a second one way clutch assembly which further aids in imparting motion to the feed roller during the opposite movement of said oscill-atable lever. A motion transfer mechanism interconnects the clutch assemblies and provides for cooperative operation, that is, opposite movement in unison such that any oscillatory movement of the rock lever will result in a feeding displacement of the metering device. The motion transfer means includes a plurality of levers, one of which is pivotally secured to the support member so as to reverse the direction of movement between the first and second clutch assemblies. A brake assembly which includes a friction block totally encompassing a portion of the outside diameter of the driven feed roller together with an adjustable resilient member combine to apply a braking force against said shaft, thus serving to prevent overthrow of the driven feed roller in the course of its operation.

As stated above, with the patented invention all of the driving movement for the roller is delivered during the downward stroke of the rock lever. This meant all of the elastic that was to be used during that stitch had to be delivered in the downward stroke, thus the curvilinear velocity of the roller had to be sufficient to perform the same. Whereas by providing a mechanism wherein movement is imparted during both directions of the rock lever, an extended period of time for supplying the same extent of material is provided. That is, by driving the roller during both lever directions a slower curvilinear speed is required thus less overthrow of the mechanism results. Due to the slower roller speed, and thus lower inertia force of the roller, a lesser extent of braking force is required to be placed on the driven roller. Another advantage by the provision of a drive working in two directions is that the braking force is applied to the feed roller in a symetrical manner. Whereas, in the Reimer patent, the braking force is not effective upon the advance of the feed roller but effective upon its return movement which results in an uneven braking effect and thus a variable force is delivered to the needle drive mechanism of the machine.

As may be apparent, the provision of the present invention has numerous advantages over the art, and has for a primary object, to provide a simple and compact means for delivering a predetermined length of material to the stitch forming area during operation of the machine.

Related to the foregoing, the present invention has for a further object the provision of the metering device having a considerably reduced inertia force value.

It is yet another object of this invention to provide means which have the same curvilinear output for only one half of the linear input as has been heretofore required.

It is a further object of this invention to provide means for providing a symetrical braking pressure on the feed roller throughout the feeding cycle.

In the accompanying drawings annexed hereto and forming part of this specification, the present invention is shown embodied as an elastic metering device associated with a sewing machine, but it will be understood that some of the features of this invention can be embodied in other devices that the drawings are not to be construed as defining or limiting the scope of the invention, the claims appended to this specification being relied upon for that purpose.

In the drawings

DESCRIPTION OF THE PREFERRED EMBODIMENT

Figure 1:
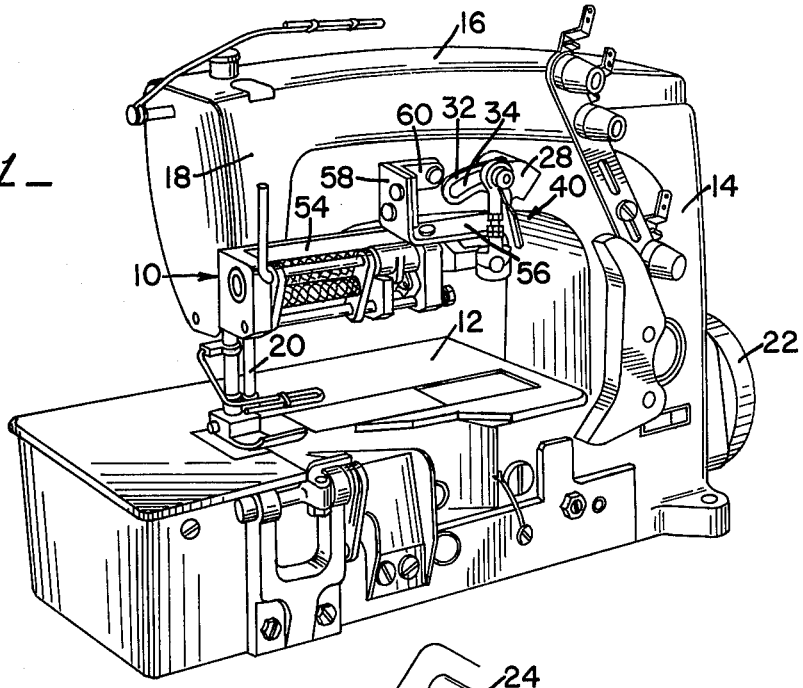
FIG. 1 is a perspective view of the sewing machine showing the present invention.

Referring now in greater detail to the various figures of the drawings wherein like reference characters refer to like parts, there is generally shown in FIG. 1 a metering device assembly means 10. For the purposes of illustration the invention has been shown as applied to a flatbed sewing machine and more particularly as applied to a Class 57700 flatbed machine manufactured by Union Special Corporation. The machine has a main hollow frame comprising a work supporting base means 12 a vertical standard means 14 and an overhanging arm means 16 terminating in a needle head means 18. Within the head there is mounted, for vertical reciprocation, a needle bar means 20 arranged to carry one or more needles (not shown). For the purpose of advancing the work in the region of the stitch forming devices, there is provided a suitable feeding mechanism (not shown) which includes a conventional feed dog and associated parts.

The sewing machine is provided with a main drive shaft (not shown) which projects outwardly from the frame at its right end (FIG. 1) and has secured thereto a combined handwheel and pulley means 22 through which power may be supplied to the machine. Although other needle drive mechanisms are common in different machines, and it should be appreciated that the present mechanism is equally applicable thereto, the needle drive mechanism employed by the present invention comprises a crank carried on the mainshaft which is connected by a pitman with the right end of a needle lever rockingly mounted in the overhanging arm 16 of the machine. The needle lever means is secured to a rock shaft means 24 (FIG. 2) by any suitable means. The rock shaft means 24 is suitably journalled in bearing sleeves provided in the front and rear walls of the overhanging wall and extends outwardly through the front wall of the arm means 16.

Figure 2:
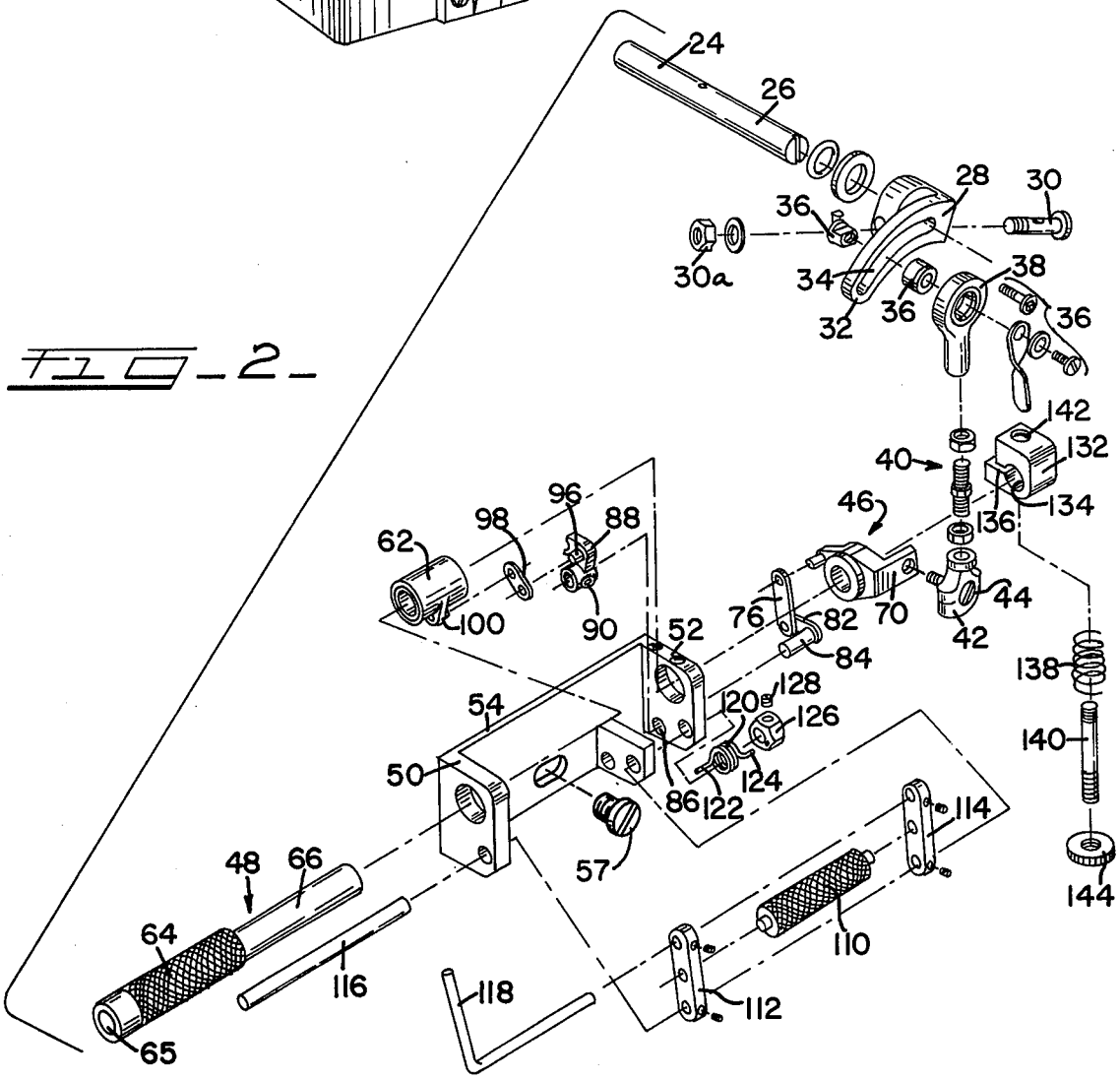
FIG. 2 is an exploded view of the metering device.

The metering device, assembly means 10 as shown in FIGS. 1 and 2, is provided for ensuring delivery of an accurately measured length of a material to the above described stitch forming instrumentalities and the work feeding devices of the sewing machine. Secured to the end 26 of the rock shaft means 24, which extends outwardly from the front wall of the overhanging arm means 16, is a lever means 28 which is oscillated by said shaft means 24. The lever means 28 has a split portion adapted to be clamped upon the shaft means 24 by any suitable means such as the bolt and nut 30 and 30*a*. Spaced outwardly from the clamping portion of the lever means 28 is an arm means 32 which extends parallel with the front face of the overhanging arm 16 and is provided with an arcuate slot means 34. Arranged for adjustment along this slot, and provided to vary the feed of the stroke which is to be imparted to the first of two metering rolls, to be hereinafter described, is a suitable connection 36 which cooperates with a strap 38 at the upper end of a link or pitman assembly means 40. The lower end of the latter is provided with a strap 42 which cooperates with a ball pin means 44 carried by a first clutch assembly means 46. The first clutch assembly means 46 is carried by the feed roller means 48 which is one of the two roller means employed with the present invention. The feed roller means 48 is suitably journalled and carried by arm means 50 and 52 of the support means 54 secured to the overhanging arm means 16. A bolt means 57 also aids in securing the assemblage to the machine. As may be best seen in FIGS. 1, 2, and 3, the support means 54 is secured to the frame of the machine by a bracket means 56 which is suitably secured to the arm means 52 of support means 54 by any suitable means such as 55. An upward extension 58 formed as an integral part of the bracket 56 combines with a second bracket means 60 which suitably secures the assemblage to the machine arm means 16.

Figure 5:
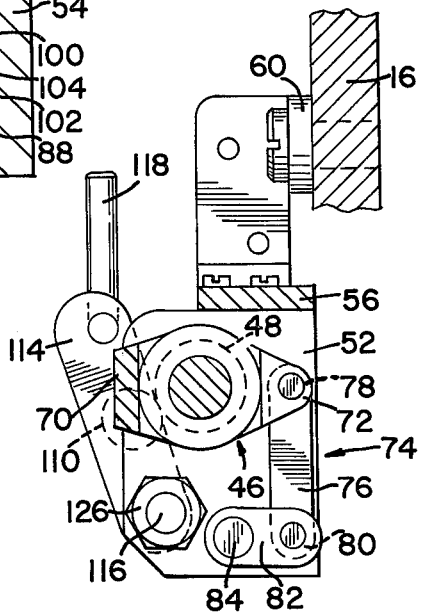
FIG. 5 is a right side elevational view showing the metering device as it is attached to the sewing machine and taken along line 5—5 of FIG. 3.

Turning now to FIGS. 2 through 5 in particular, there is shown a series of one way coupling means that permit the present metering device to utilize both oscillatory movements of the pitman assembly means 40 which, as described above, is actuated through means of the rock lever 24. Both of the one way couplings are free to turn in a clockwise direction but instantly grip the feed roller when driven in a counter clockwise direction. As will be understood from the following, any equivalent one way coupling or clutch device, in place of the roller clutches employed by the present invention, may be employed for the purpose of the invention, the function and operation of which is substantially independent of the special type of one way clutch or couplings used. In addition to the first one way clutch assembly means 46 being carried by the feed roller means 48 there is a second one way clutch assembly means 62 which associates therewith and cooperates in unison with the first clutch means in controlling the movement of the feed roller means 48. As may be best seen in FIGS. 2, 3 and 5 the feed roller means 48 has a first portion means 64 having a friction engaging surface means and a second portion means 66. The first portion means 64 has a bore means 65 extending for a good portion of the length thereof which is provided for reducing the inertia value of the roller means 48. As best seen in FIG. 5 the first one way clutch assembly means 46 is provided with a first extension means 70 which serves as the connection for the pitman assembly means 40 and a second extension 72 extending in an opposite direction. Pivotly connected to the second extension means 72 is one end of a motion transfer assemblage means 74 the purpose of which is to connect the first one way clutch means 46 with the second one way clutch means 62 while providing for cooperating opposite movement in unison of the clutch assemblies.

The motion transfer assembly means 74 includes a link means 76 having first end means 78 which is articuately connected to the second extension means 72 of the one way clutch means 46. Pivotly secured to the opposite end means 80 of the link means 76 is a lever means 82. The end of the lever means 82 opposite to the articulate connection is provided with a horizontally extending stub shaft means 84. The stub shaft means 84 is pivotally carried in an aperture 86 in the arm means 52 of support means 54. On the side of the arm means 52 opposite to that on which the first coupling assembly means 46 is carried is a link means 88 which is secured at its first end means 89 by any suitable means such as 90 to the shaft means 84 as may best be seen in FIG. 4. The link means 88 has provided at its center portion means 94 a pin means 96 which is articuately associated with a link member means 98. The link member means 98 is connected at the end opposite the articulate connection 96 with an extension means 100 on the one way clutch assembly means 62. The second end means 102 of the link means 88 serves as a thrust surface for the link means 98. Pin means 104 connects the link 98 with the clutch assemblage means 62. As mentioned above, by the provision of such a motion transfer means the pivotal connection provided by the shaft 84 changes the direction of force between the two coupling drives such that a driving force may be delivered to the feed roller upon both directions of movement of the needle drive means.

Cooperating with the feed roller means 48 is a smaller feed roller means 110 (FIGS. 2 and 5) which serves to hold the material against feed roller 48 and grip it to prevent slippage. As shown, roller 110 is preferably provided with a friction engaging surface which may be of any configuration on both rollers 48 and 110. Roller 110 is carried by a pair of arms 112 and 114 which are secured to a shaft 116 journalled in the forwardly extending arms 50 and 52 of the support means 54. A handle means 118 is suitably secured in the arm 112 and 114 at an end opposite the shaft 116 for reasons hereinafter discussed. As viewed in FIG. 3 at its right end means shaft means 116 is surrounded by a torsion spring means 120. The spring means 120 has its first end means 122 inserted in an aperature in the arm 52 and its second end means 124 engaged with a collar means 126 secured to the outer end of the shaft means 116 by any suitable means such as 128. The arrangement is such that the spring means 120 tends to urge the shaft 116 in a clockwise direction as shown in FIG. 5 and thus retains the roller means 110 in frictional engagement with the roller means 48. When it is desired to remove or rotate the roller means 110 away from the feed roller means 48 the operator pulls on the member 118 thus rotating the arms 112 and 114 and thus the roller 110 carried thereby, in a direction away from the feed roller means 48.

Figure 3:
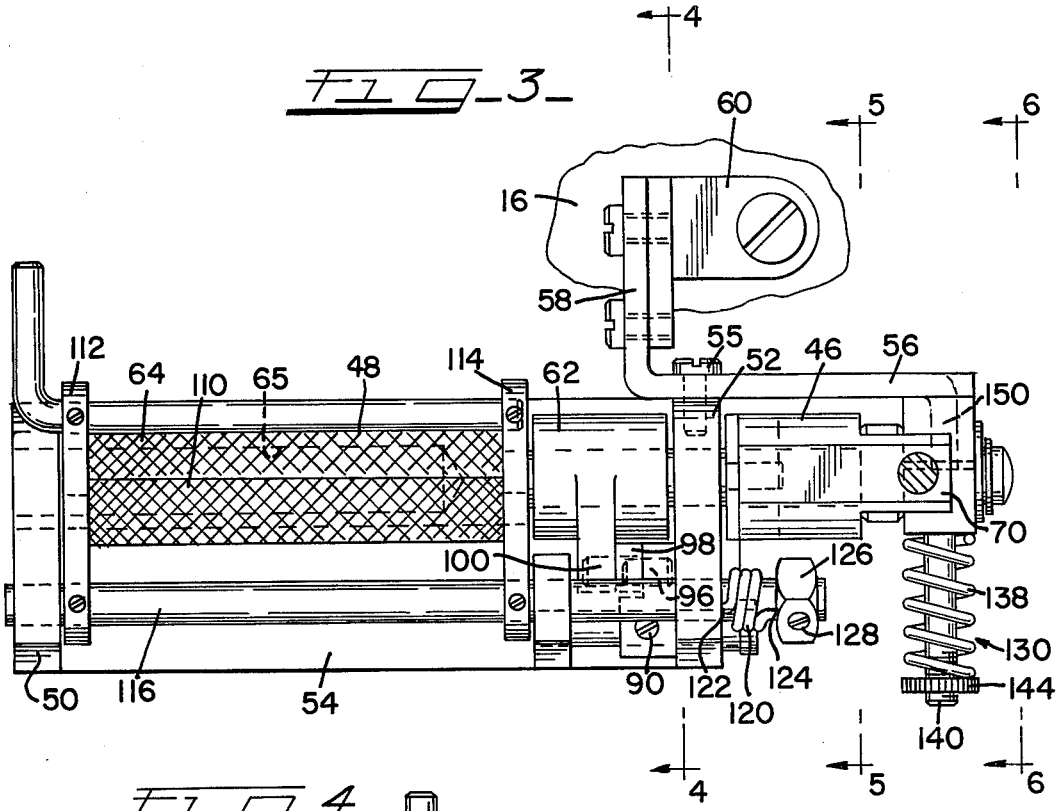
FIG. 3 is a front elevational view showing in greater detail the present invention.
Figure 4:
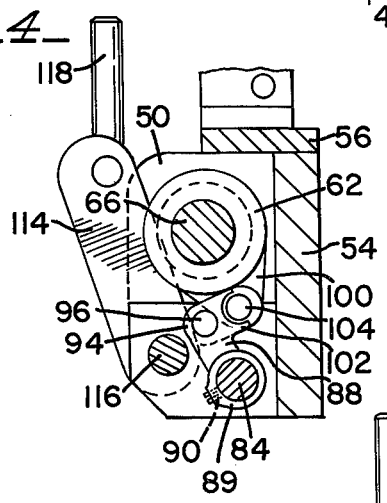
FIG. 4 is a right side elevational view partially shown in section and taken along line 4—4 of FIG. 3.
Figure 6:
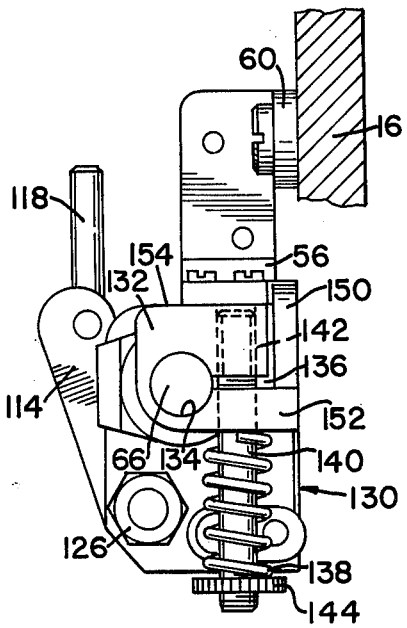
FIG. 6 is an additional right side elevational view taken along line 6—6 and showing the brake assembly as mounted on the driven feed roller.

Outwardly or to the right as seen in FIG. 3 of the first clutch assembly means 46 is a brake assembly means 130. As may be best seen in FIGS. 2, 3 and 6 the brake assembly means includes a brake block 132 which may be formed of any suitable material such as nylon, etc. This brake block means 132 is provided with an aperature 134 which totally encompasses a section of the second portion means 66 of feed roller means 48. The block means 132 which has a split portion means 136 is adapted to be rotatably clamped upon the shaft by an adjustment means which applies asymmetrical braking force upon the roller means 48. The adjustment means is comprised of a spring means 138, a threaded rod means 140 which threadably associates with a threaded aperature 142 in block 132 and a screw means 144 which adjusts the amount of compressive force which is to be applied. To prevent rotation of the block means 132 during its braking action, the support bracket means 56 is provided with a downwardly extending finger means 150 which associates with a portion 152 on the block means 132 so as to prevent rotation of the block 132 in a counterclockwise manner as seen in FIG. 6. In view of the constant pressure on the block, and a non turning assemblage there is a symetrical braking force, that is a force which is equal during all feeding motions of the feed roller 48, being applied to the feed roller and thus a symetrical braking force is supplied to the driven mechanism of the machine.

OPERATION OF THE DEVICE

The operation of the metering device shown and before described will become further apparent from the following. During each cyclic movement of the needle drive lever, an oscillating movement will be imparted to the lever means 28 by way of the rock shaft 24. As a consequence, the pitman assembly means 40 forcibly drives a first extension means 70 on the first clutch assembly means 46 in a counterclockwise manner thus causing the clutch assembly to instantly grip the feed roller means 48 and forcibly drive the latter during the downward motion of the lever 28. At the same time, that is during the downward oscillation of lever means 28, the second extension means 72 is also turned in a counterclockwise direction thus imparting an upward motion to the link means 76 as seen in FIG. 5. As a consequence of link means 76 upward movement the stub shaft 84 means is driven in a counterclockwise direction. The link means 88 carried on the stub shaft 84 is turned in a counterclockwise direction about the longitudinal axis of the shaft 84. The counterclockwise turning motion of link means 88 causes the second clutch assembly means 62 to be driven in a clockwise direction about the longitudinal axis of the feed roller means 48. In view of the fact that the clutch assembly means 62 is driven in a clockwise direction, that is opposite to that direction in which the first clutch assembly means is being driven, the second clutch assembly in itself is decoupled from the feed roller means 48 and does not impart any gripping action upon the shaft but whereas as stated above both the clutches are free to turn in the clockwise direction. This is to say, during the downward stroke of the rock lever 28 the first clutch assembly 46 is moving the feed roller means 48 while the second clutch assembly means 62 is being displaced from its initial position to a second position without imparting motion to the feed roller.

On the other hand, when the oscillating lever means 28 is returned to its initial position, the operation of the one way couplings 46 and 62 is exchanged as far as the effectiveness of the couplings in transmitting torque to the feed roller means 48 is concerned. That is, the coupling means 62 moved during the downward displacement of the lever means 28 will be effective to forcibly drive in a unilateral direction the feed roller means 48. When the lever means 28 is returned it forcibly drives the motion transfer means in an opposite direction to that in which it was initially moved, thus the one way clutch means 62 controls the movement of the roller while the one way clutch means 46 is free to turn in a clockwise manner. Due to the movement in a clockwise direction of the clutch means 46 the motion transfer means transfers in the opposite direction a counterclockwise movement onto the second clutch assembly means 62 whereby instantly griping the feed roller means 48 and forcibly drives the latter in a unilateral direction.

In brief, the oscillating connection associated with the needle drive mechanism of the machine during its first half of cyclic motion imparts a driving motion to the feed roller 48 through the first clutch assembly means 46, while the second clutch assembly means 62 is driven in a direction opposite to that of the first clutch assembly means. On the other hand, during the second half cyclic movement of the rock lever the second one way clutch assembly means 62 cooperates with the feed roller 48 and drives the same while the one way assembly means 46 remains inoperative and is returned to its initial position and so on during the following oscillations of the lever means 28 by the needle drive. By driving the feed for the metering device in such a manner a more uniform speed or velocity for the feed roller is achieved while at the same time only one half of the linear input is necessary to produce an equal amount of curvilinear output of the feed roller means. In this manner there is no wasted motion. In addition to the foregoing, the brake assembly means 130 associated with the above identified mechanism provides for a symmetrical braking force to be applied to the feed roller means 48 whereby the same inertia value is inherent with the operating connection means 40 either during its downward motion or its upward motion whereby producing a more uniform force to be applied to the needle drive shaft.

Thus it is apparent that there has been provided, in accordance with the invention, a metering device for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An attachment for use with a sewing machine having a mechanism drive means, and lever means operably connected to said drive means to be reciprocated thereby, said attachment comprising:

a support means;

roller means carried by said support means including coaxially aligned first and second one way coupling means being associated therewith;

one of said coupling means being in operative engagement with said lever means for driving said roller means upon one direction of movement of said lever means; and means for dependently associating said coupling means such that return movement of said lever results in the other coupling means driving said roller means.

2. The attachment of claim 1 wherein said support means is removably secured to said sewing machine.

3. The attachment of claim 1 wherein each of said couplings is comprised of a roller clutch means running freely when driven in one direction and gripping instantly when driven in the opposite direction.

4. The attachment of claim 1 wherein said means interconnecting said coupling means being operable to move one of said coupling means upon the movement of the other of said coupling means.

5. The attachment of claim 1 wherein said support means includes at least one arm means being displaced between said first and second one way coupling means.

6. The attachment of claim 6 wherein said means interconnecting said coupling means includes a plurality of link means and a pivotal connector between said links, said pivotal connector passing through said arm means wherein angular displacement of one coupling means results in an opposite angular displacement of the other coupling means.

7. An elastic metering attachment for a sewing machine having a frame, a needle drive means, oscillatory means connected to said needle drive means said attachment comprising:

support means;

first and second feed roller means carried by said support means for advancing a strip of material;

coaxially aligned first and second one way clutch assembly means, one of said clutch assembly means being responsive to one direction of movement of said oscillatory drive means for driving said feed roller means and the other of said clutch assembly means being responsive to the other direction of movement of said oscillatory drive means for unilaterally driving said feed roller means; and motion transfer means operably connecting said first clutch assembly means with said second clutch assembly means in a dependent relationship whereby movement of either clutch assembly means displaces the other an equal amount.

8. An elastic metering attachment according to claim 7 wherein said second roller means is pivotly carried by said support means and is resiliently urged toward said first feed roller to grip the material against the latter.

9. An elastic metering attachment according to claim 8 wherein said resilient urging means is adjustable.

10. An elastic metering attachment according to claim 7 wherein said motion transfer means includes a plurality of linkage means, at least one of said links being pivotly secured to said support means.

11. An elastic metering attachment according to claim 10 wherein said pivotly mounted link changes the direction of motion delivered between said clutch assembly means.

12. In a sewing machine having a frame means with a work support means, means for driving a stitch forming instrumentality, main feed mechanism means operable at a predetermined rate of speed, and an auxiliary feeding mechanism comprising:

a support means secured to said frame means;

a pair of cooperating feed roller means for positively gripping and feeding material;

first and second clutch means coaxially mounted on one of said roller means and operative to impart movement thereto;

oscillatory means operatively connected to said drive means for moving said first clutch means whereby driving said roller means upon one direction of movement; and means dependently interconnecting said first and second clutch means for cooperative movement in unison and in opposite directions so as to positively drive said roller means through said second clutch means upon return movement of said oscillatory means.

13. An auxiliary feeding mechanism of claim 12 wherein the rate of feed of said auxiliary feeding mechanism is less than the rate of feed of said main feed mechanism.

14. The auxiliary feeding mechanism of claim 12 wherein said first and second clutch means, are located remote from one another, one of said clutches being arranged to operably connect said drive means with said roller means during the one direction of movement of said oscillatory means, the other of said clutch means operably connecting said drive means with said roller means through said interconnecting means during the oppositely directed movement of said oscillatory means.

15. The auxiliary feeding mechanism of claim 12 wherein said oscillatory means comprises a rock lever connected to the drive means, said lever being provided with an elongated slot means, and a member adjustable along said slot to vary the rate of feed of at least one of said feed rollers.

16. The auxiliary feeding mechanism of claim 12 wherein said driven roller means is comprised of a first section means having a friction engaging surface and a hollow center section along a portion of its length and a second portion means extending the remaining distance of said feed roller means.

17. The auxiliary feeding mechanism of claim 16 further including a resiliently urged friction means carried by said roller means cooperating with the outer surface thereof to prevent overthrow of said roller means in the direction of feed.

18. The auxiliary feeding mechanism of claim 17 wherein said resiliently urged friction means is comprised of a block means encompassing a portion of the second portion means on said feed roller means and a spring means for biasing said block thereagainst.

19. The auxiliary feeding mechanism of claim 18 wherein the force applied by said biasing means is adjustable.

20. An auxiliary feed mechanism for a sewing machine comprising:

a drive means;

oscillatable means operably connected to said drive means;

main feed mechanism means;

a pair of rotatable feed roller means for feeding a strip of elastic material;

a series of clutch means coaxially arranged on one of said feed roller means for imparting to the latter a unilateral work feeding movement during each direction of movement of said oscillatable means of sufficient magnitude to advance and elasticize said strip between said feed mechanism and said roller means;

a motion reversal mechanism means mounted between and connecting said clutches; and said series of clutches are dependent of each other.

21. The auxiliary feed mechanism of claim 20 further including means for adjusting the amount of work advancing movement of said feed roller means in accordance with the requirement of the work being sewn.

* * * * *